US007258375B1

(12) United States Patent
Shen

(10) Patent No.: US 7,258,375 B1
(45) Date of Patent: Aug. 21, 2007

(54) TELESCOPIC CHOPSTICK

(75) Inventor: Shun Tsung Shen, Pu-Li Township, Nuan-Tou County (TW)

(73) Assignee: Jing Si Publications Co., Ltd., Taipei (TW)

( * ) Notice: Subject to any disclaimer, the term of this patent is extended or adjusted under 35 U.S.C. 154(b) by 0 days.

(21) Appl. No.: 11/390,092

(22) Filed: Mar. 28, 2006

(51) Int. Cl.
*A47G 21/10* (2006.01)

(52) U.S. Cl. ..... 294/1.1; 294/5.5

(58) Field of Classification Search ..... 294/1.1, 294/5.5, 7, 99.2; 30/322–324, 326, 340
See application file for complete search history.

(56) References Cited

U.S. PATENT DOCUMENTS 4,707,922 A * 11/1987 Hosak-Robb ..... 30/322
5,431,465 A * 7/1995 Shibata ..... 294/1.1
D368,413 S * 4/1996 Lowenfels ..... D7/653
5,810,411 A * 9/1998 Major ..... 294/99.2
6,328,360 B1 * 12/2001 Freeman ..... 294/1.1
7,093,868 B1 * 8/2006 Shen ..... 294/1.1

* cited by examiner

*Primary Examiner*—Dean J Kramer
(74) *Attorney, Agent, or Firm*—Rosenberg, Klein & Lee

(57) ABSTRACT

A telescopic chopstick including an upper section, a lower section and a press member. The upper section is a hollow rod formed with an upper opening and a lower opening. A locating section is formed on an inner side of the upper section. The lower section has an upper end and a lower end. The upper end has a peripheral length larger than a peripheral length of the lower end. The upper end of the lower section has a connecting section for engaging with the lower end of the upper section. The press member is fitted in the upper opening of the upper section and located by the locating section of the upper section. A leaf spring integrally extends from a bottom end of the press member. When the lower section is retracted into the upper section, the leaf spring resiliently abuts against and engages with a lateral wall of the connecting section of the lower section. The lower section can be easily taken out from the upper opening of the upper section for washing.

4 Claims, 5 Drawing Sheets

TELESCOPIC CHOPSTICK

BACKGROUND OF THE INVENTION

The present invention is related to an improved telescopic chopstick in which a lower section can be retracted into an upper section of the chopstick. In addition, the lower section can be easily taken out from the upper opening of the upper section for washing to meet the requirement for sanitation.

FIG. 5 shows a conventional telescopic chopstick 5. The telescopic chopstick 5 includes an upper section 51, a lower section 52 and a press member 6. The top end of the lower section 52 is engaged with the bottom end of the upper section 51 to integrally connect the lower section 52 with the upper section 51. The upper section 51 has an upper opening 511 and a lower opening 512. The lower section 52 can be fitted into the upper section 51 from the upper opening 511.

The press member 6 includes a press button 61 and a jacket 62. The press button 61 has a press section 611 and a stem 612 formed with a stopper section 613. The jacket 62 is a hollow member fitted in the upper opening 511 of the upper section 51. The jacket 62 has a locating section 621 and a stop flange 622. The locating section 621 is formed with a pair of transverse locating holes 623 opposite to each other. In addition, the inner wall face of the locating section 621 is formed with a slide channel 624 having a lower opening. The stopper section 613 of the stem 612 is slidably inlaid in the slide channel 624.

The inner wall face of the upper section 51 is further formed with a pair of opposite lower protuberances 513 and a pair of opposite upper protuberances 514 near the upper opening 511. When the lower section 52 is retracted into the upper section 51, the lower protuberances 513 are compressed to locate the lower section 52. The upper protuberances 514 serve to engage with the press member 6 for combining the press member 6 with the upper section 51.

The width of the top end of the lower section 52 is larger than the interval between the opposite lower protuberances 513. In addition, the lower protuberances 513 are formed on an inflexible portion of the upper section 51. Therefore, when it is desired to take out the lower section 52 of the telescopic chopstick for washing, it is hard to change the interval between the lower protuberances 513. Consequently, it is uneasy to take out the lower section 52 from the upper section 51. A user often needs to push the lower section 52 with an alien piece such as another telescopic chopstick. This is quite inconvenient. Moreover, it is laborious and time-consuming to process the upper section 51 to form the lower protuberances 513 and the upper protuberances 514. Therefore, the manufacturing cost is increased.

SUMMARY OF THE INVENTION

It is therefore a primary object of the present invention to provide an improved telescopic chopstick in which a lower section is retractable in an upper section of the chopstick. In use, a user can forcedly press a press member to disengage a lower section of the chopstick from a leaf spring of the press member. At this time, the lower section will instantaneously bound outward from an upper section for use. When it is desired to wash the chopstick, the press member is forcedly drawn out from an upper opening of the upper section. Therefore, the lower section can be easily taken out from the upper opening of the upper section for washing. The press member with the leaf spring has simple structure and is easy to manufacture. Therefore, the manufacturing cost of the telescopic chopstick is greatly reduced.

According to the above object, the telescopic chopstick of the present invention includes:

an upper section which is a hollow rod with an upper end and a lower end, the upper end being formed with an upper opening, while the lower end being formed with a lower opening, a locating section being formed on an inner side of the upper section near the upper opening;

a lower section having an upper end and a lower end, the upper end having a peripheral length larger than a peripheral length of the lower end, the upper end of the lower section having a connecting section for engaging with the lower end of the upper section; and a press member fitted in the upper opening of the upper section and located by the locating section of the upper section, a leaf spring integrally extending from a bottom end of the press member, whereby when the lower section is retracted into the upper section, the leaf spring resiliently abuts against and engages with a lateral wall of the connecting section of the lower section.

The present invention can be best understood through the following description and accompanying drawings wherein:

DETAILED DESCRIPTION OF THE PREFERRED EMBODIMENTS

Figure 1:
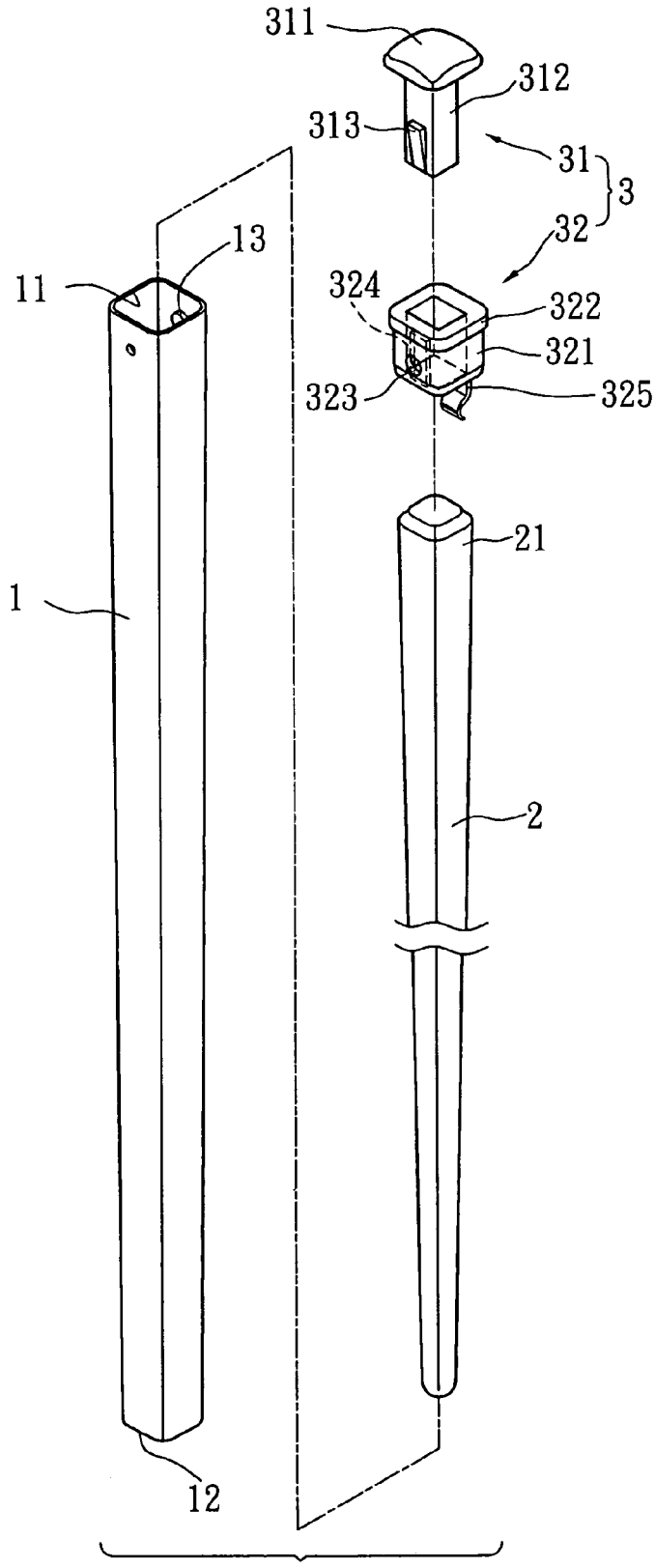
FIG. 1 is a perspective exploded view of the telescopic chopstick of the present invention.
Figure 2:
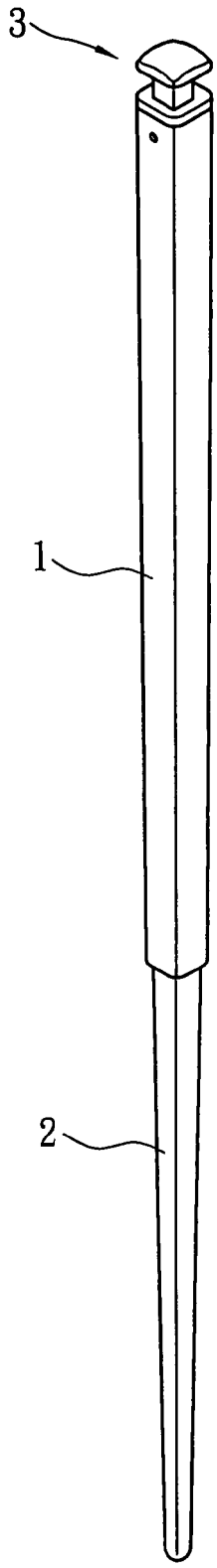
FIG. 2 is a perspective assembled view of the telescopic chopstick of the present invention.
Figure 3:
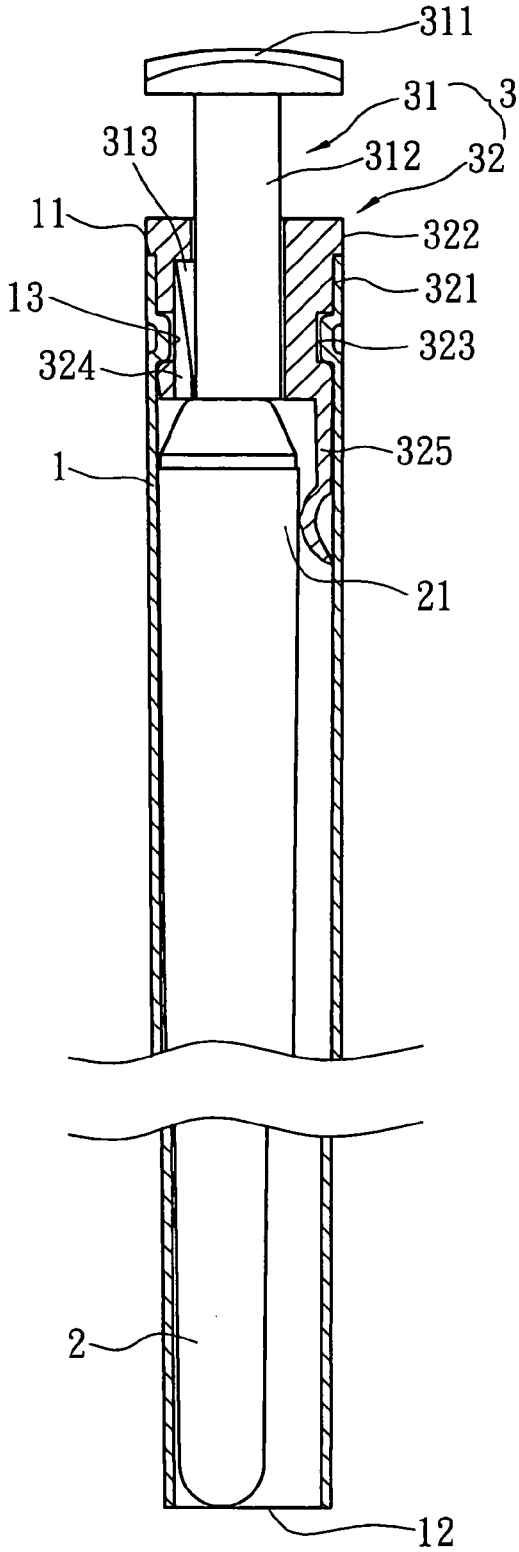
FIG. 3 is a sectional assembled view of the telescopic chopstick of the present invention.

Please refer to FIGS. 1 to 4. The telescopic chopstick of the present invention includes an upper section 1. The upper section 1 is a hollow rod with an upper end and a lower end. The upper end is formed with an upper opening 11, while the lower end is formed with a lower opening 12. A locating section 13 is formed on an inner side of the upper section 1 near the upper opening 11. In this embodiment, the locating section 13 is a pair of protuberances formed on opposite inner sides of the upper section 1 near the upper opening 11.

The telescopic chopstick of the present invention further includes a lower section 2 having an upper end and a lower end. The peripheral length of the upper end is larger than the peripheral length of the lower end. The upper end of the lower section 2 has a connecting section 21 for engaging with the lower end of the upper section 1. The lower end of the lower section 2 can be fitted into the upper opening 11 of the upper section 1. The inner peripheral length of the lower opening 12 of the upper section 1 is smaller than the outer peripheral length of the connecting section 21 of the lower section 2, whereby the lower section 2 can be engaged with the upper section 1.

The telescopic chopstick of the present invention further includes a press member 3 including a press button 31 and a jacket 32. The press button 31 has a press section 311 and a stem 312 extending from the press section 311. A stopper section 313 is formed on one side of the stem 312. In this embodiment, the jacket 32 is a hollow member fitted in the upper opening 11 of the upper section 1. The jacket 32 has a locating section 321 and a stop flange 322. The locating section 321 is formed with a pair of locating holes 323 opposite to each other. The protuberances 13 of the upper section 1 can be inlaid in the locating holes 323 to locate the jacket 32. In addition, the inner wall face of the jacket 32 is formed with a slide channel 324 having a lower opening. The stopper section 313 of the stem 312 is slidably inlaid in the slide channel 324. A leaf spring 325 integrally extends from one side of a bottom end of the jacket 32. When the lower section 2 is retracted into the upper section 1, the leaf spring 325 resiliently abuts against and engages with a lateral wall of the connecting section 21 of the lower section 2.

Figure 4:
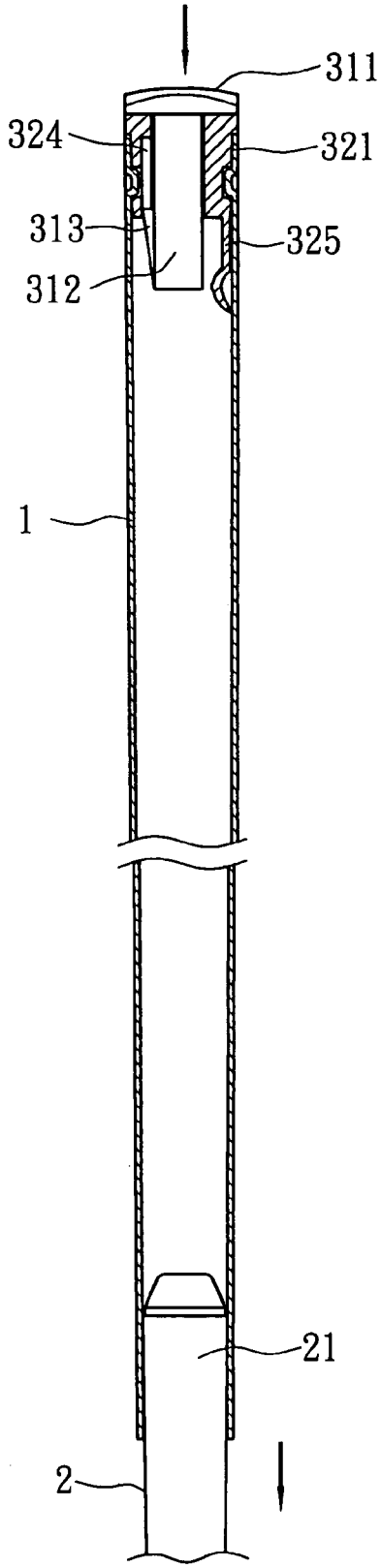
FIG. 4 is a sectional assembled view of the telescopic chopstick of the present invention, showing that the lower section is released from the leaf spring of the press member to extend out from the upper section.
Figure 5:
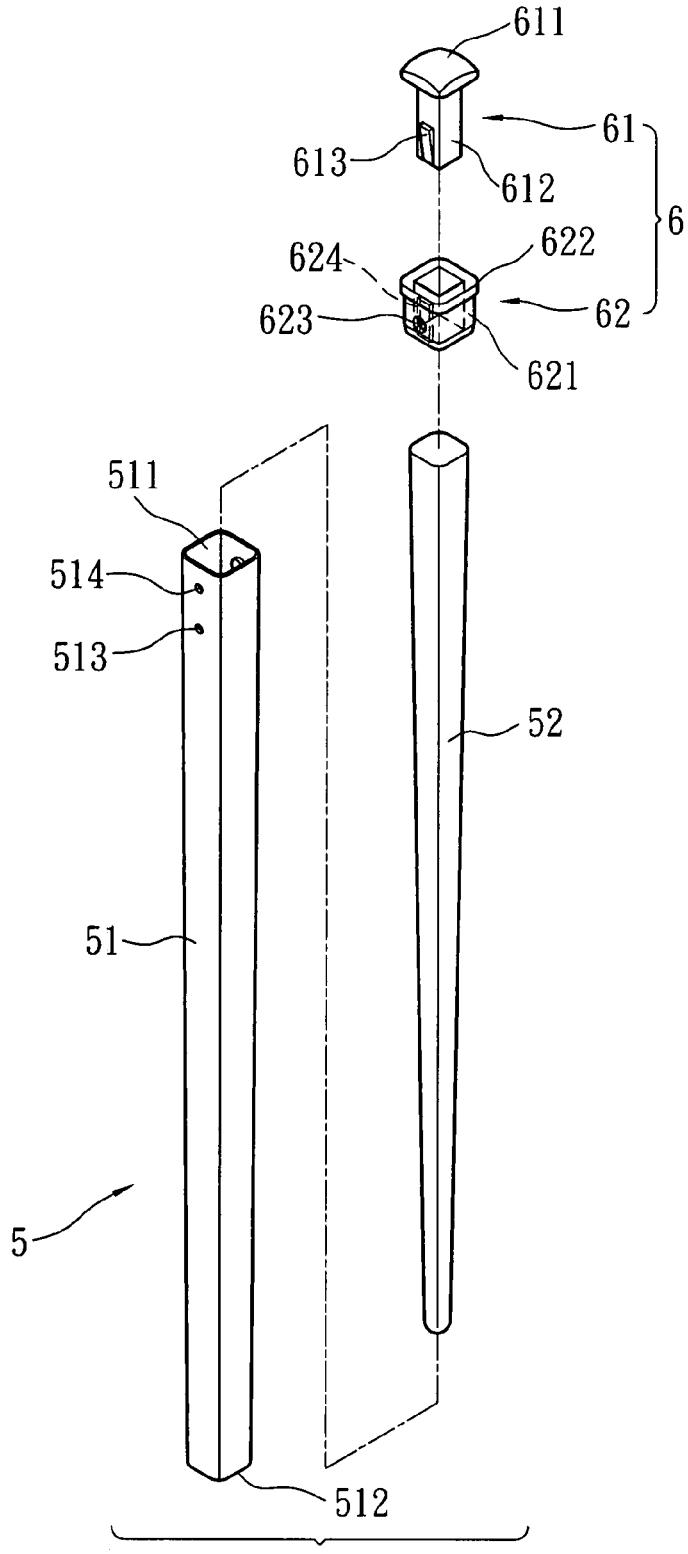
FIG. 5 PRIOR ART
FIG. 5 is a perspective exploded view of a conventional telescopic chopstick.

Referring to FIG. 4, in use, the stopper section 313 of the press button 31 is slidably inlaid in the slide channel 324 of the inner side of the jacket 32. Under such circumstance, a user can forcedly press the press section 311 of the press button 31. At this time, the stem 312 is pushed to force the lower section 2 to disengage from the leaf spring 325. Once the pushing force exerted onto the lower section 2 exceeds the abutting pressure of the leaf spring 325 applied to the lower section 2, the lower section 2 instantaneously bounds outward from the upper section 1. At this time, the connecting section 21 of the lower section 2 is engaged with the lower end of the upper section 1 without detaching therefrom for a user to use.

When it is desired to wash the chopstick, the press member 3 is forcedly drawn out from the upper opening 11 of the upper section 1. When the drawing force exceeds the engaging force between the locating holes 323 of the jacket 32 and the protuberances of the upper section 1, the press member 3 is drawn out from the upper section 1. At this time, the leaf spring 325 is drawn out along with the press member 3 to release the connecting section 21 of the lower section 2. The interval between the opposite protuberances 13 near the upper opening 11 of the upper section 1 is larger than the width of the connecting section 21 of the lower section 2. Therefore, the lower section 2 can be easily taken out from the upper opening 11 of the upper section 1 for washing. Also, the inner sides of the upper section 1 can be easily washed. After cleaned, the components of the telescopic chopstick can be reassembled for further use. The press member 3 with the leaf spring 325 has simple structure and is easy to manufacture. Therefore, the manufacturing cost of the telescopic chopstick is greatly reduced.

The above embodiments are only used to illustrate the present invention, not intended to limit the scope thereof. Many modifications of the above embodiments can be made without departing from the spirit of the present invention.

What is claimed is:

1. A telescopic chopstick comprising:

an upper section which is a hollow rod with an upper end and a lower end, the upper end being formed with an upper opening, while the lower end being formed with a lower opening, a locating section being formed on an inner side of the upper section near the upper opening;

a lower section having an upper end and a lower end, the upper end having a peripheral length larger than a peripheral length of the lower end, the upper end of the lower section having a connecting section for engaging with the lower end of the upper section; and a press member fitted in the upper opening of the upper section and located by the locating section of the upper section, a leaf spring integrally extending from a bottom end of the press member, whereby when the lower section is retracted into the upper section, the leaf spring resiliently abuts against and engages with a lateral wall of the connecting section of the lower section.

2. The telescopic chopstick as claimed in claim 1, wherein the press member includes a press button and a jacket, the press button having a press section and a stem extending from the press section, a stopper section being formed on one side of the stem, the jacket being a hollow member fitted in the upper opening of the upper section, the jacket having a locating section and a stop flange, the locating section being formed with a pair of locating holes opposite to each other, whereby the locating section of the upper section can be inlaid in the locating holes to locate the jacket, an inner wall face of the jacket being formed with a slide channel having a lower opening, the stopper section of the stem being slidably inlaid in the slide channel, the leaf spring integrally extending from one side of a bottom end of the jacket.

3. The telescopic chopstick as claimed in claim 1, wherein the lower end of the lower section can be fitted into the upper opening of the upper section, the lower end of the upper section having an inner peripheral length smaller than the outer peripheral length of the connecting section of the lower section, whereby the lower section can be engaged with the upper section.

4. The telescopic chopstick as claimed in claim 1, wherein the locating section of the upper section is a pair of protuberances formed on opposite inner sides of the upper section near the upper opening thereof.

* * * * *